United States Patent [19]

Stagni et al.

[11] Patent Number: 4,979,295

[45] Date of Patent: Dec. 25, 1990

[54] PROCESS FOR THE MANUFACTURE OF A FUEL MANIFOLD FOR AN INTERNAL COMBUSTION ENGINE FUEL SUPPLY SYSTEM

[75] Inventors: Rino Stagni, S. Pietro; Massimo Lolli, Bologna, both of Italy

[73] Assignee: Weber S.r.l., Turin, Italy

[21] Appl. No.: 351,521

[22] Filed: May 12, 1989

[30] Foreign Application Priority Data

May 13, 1988 [IT] Italy ..... 67448 A/88

[51] Int. Cl.[5] ..... F02M 55/02

[52] U.S. Cl. ..... 29/890.052; 29/509; 29/512; 29/523; 123/470

[58] Field of Search ..... 29/156.4 R, 156.7 R, 29/157 R, 157 T, 469.5, 509, 512, 523, 157.4 R, 890.056; 123/468, 470

[56] References Cited

U.S. PATENT DOCUMENTS

| | | | |
|---|---|---|---|
| 2,535,470 | 12/1950 | Welshman | 29/512 |
| 2,896,975 | 7/1959 | Wahl et al. | 29/156.4 R |
| 3,428,338 | 2/1969 | Corwin | 29/523 |
| 4,142,581 | 3/1979 | Yoshitomi et al. | 29/523 |
| 4,457,280 | 7/1984 | Hudson, Jr. | 123/468 |
| 4,519,368 | 5/1985 | Hudson, Jr. | 123/468 |
| 4,622,732 | 11/1986 | Broderick | 29/523 X |
| 4,751,904 | 6/1988 | Hudson, Jr. | 123/470 |

*Primary Examiner*—P. W. Echols
*Assistant Examiner*—I. Cuda
*Attorney, Agent, or Firm*—Jeffers, Hoffman & Niewyk

[57] ABSTRACT

A process for the manufacture of a fuel manifold designed to supply fuel to a number of fuel injectors includes forming the end of each of a number of cup shaped fittings into a rod having an axial hole, forming on an elongated semifinished metal part a series of seats for the aforementioned rods, inserting the rods inside the seats an permanently deforming the rods against the respective seats for securing the fittings to the semifinished metal part.

4 Claims, 2 Drawing Sheets

PROCESS FOR THE MANUFACTURE OF A FUEL MANIFOLD FOR AN INTERNAL COMBUSTION ENGINE FUEL SUPPLY SYSTEM

BACKGROUND OF THE INVENTION

The present invention relates to a process for the manufacture of a fuel manifold for an internal combustion engine fuel supply syste, which is designed to supply fuel to a number of injectors.

The process according to the present invention is particularly suitable for manufacturing manifolds having an elongated semifinished metal part having at least one axial hole; a number of first cup-shaped fittings, each defining a housing for a respective injector communicating with the axial hole on the semifinished part; and at least one pair of second fittings, each designed to connect one end of the hole to members and piping on the fuel supply system.

SUMMARY OF THE PRESENT INVENTION

The aim of the present invention is to provide a process for the manufacture of a fuel manifold for an internal combustion engine fuel supply system, designed to supply fuel to a number of injectors and substantially comprising an elongated semifinished metal part having at least one axial hole; a number of first cup-shaped fittings, each defining a housing for a respective injector communicating with the axial hole in the semifinished part; and at least one pair of second fittings, each designed to contact one end of the hole to members and piping on the fuel supply system; characterised by the fact that it comprises mechanical machining operations for:

forming the end of each first fitting into a short rod having an axial hole communicating with the housing;

forming on the semifinished metal part a series of seats, each communicating with the axial hole in the semifinished part;

inserting the rod of each first fitting inside a respective seat on the semifinished part and;

permanently deforming each rod against a respective seat so as to secure the fitting to the semifinished metal part.

BRIEF DESCRIPTION OF THE DRAWINGS

The process according to the present invention will be described by way of example with reference to the accompanying drawings, in which.

DETAILED DESCRIPTION OF THE INVENTION

Figure 1:
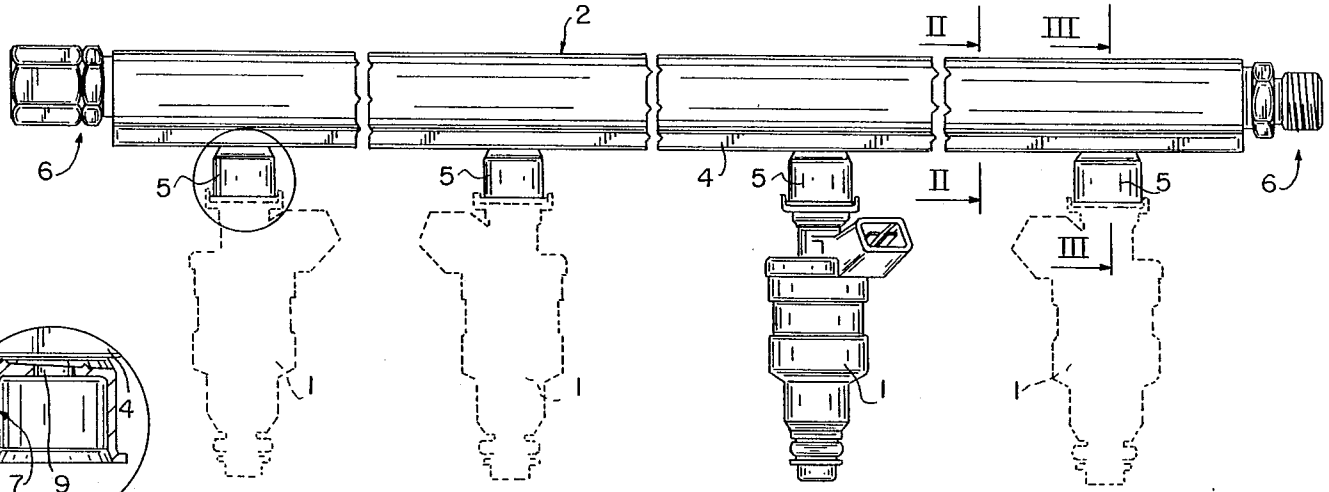
FIG. 1 shows a side view of the manifold according to the present invention.
Figure 1A:
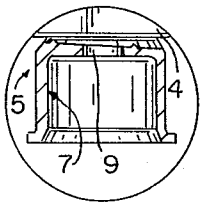
FIG. 1A shows an enlarged view of the circled portion of FIG. 1.

The process according to the present invention may be employed for manufacturing manifolds of the type shown in FIG. 1, which is designed to supply fuel to a number of injectors 1 forming part of an internal combustion engine fuel supply system.

Figure 2:
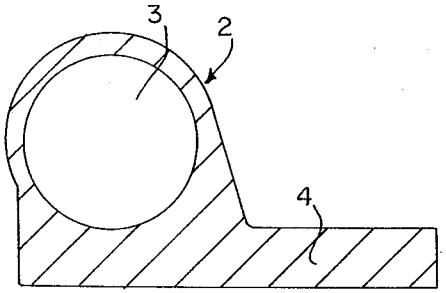
FIG. 2 shows a section of the FIG. 1 manifold along line II—II.

The manifold substantially comprises an elongated semifinished metal part 2 having an axial hole 3 and a continuous tab 4 projecting from one side of semifinished metal part 2. As shown in FIG. 2, semifinished part 2 presents a substantially constant cross section, and is extruded, conveniently from aluminium or aluminium alloy.

Said manifold also comprises a number of first fittings 5 designed to connect axial hole 3 on semifinished part 2 to injectors 1, the axis of each the injector 1 being incident with the axis of hole 3. In particular, the axis of each fitting 5 forms a 90 ° angle with the axis of said hole 3.

The manifold also comprises at least a pair of second fittings 6, each having an axis coincident with that of hole 3, and designed to connect one end of hole 3 to members and piping on the fuel supply system. Tab 4 may present holes for connecting the manifold to the crankcase, e.g. by means of threaded members. As shown in FIG. 1, each fitting 5 is cup-shaped and defines a substantially cylindrical housing 7 for the top end of an injector 1.

The process according to the present invention relates to the connection of fittings 5 to semifinished part 2 in such a manner as to form an assembly wherein said connection presents the same mechanical resistance as an assembly formed in one piece, and also provides for perfect sealing for preventing fuel leakage.

According to the present process, the end of each fitting 5 is formed into a rod 8 having an axial hole 9 communicating with housing 7. This may be achieved via chip-forming machining (turning and drilling) or via permanent deformation.

According to the present process, a series of seats 12, each designed to receive a respective rod 8, is formed, e.g. drilled, in semifinished part 2.

Rod 8 of each fitting 5 is then inserted inside a respective seat 12, and permanently deformed against the surface of the same. This is done by fitting through hole 9 on rod 8 a deforming tool 10 (FIG. 3) larger than the hole itself, and conveniently presenting a head 14 connected to a bar 13. The maximum diameter of head 14 is larger than that of hole 9, and is so selected as to provide for a given interference between head 14 and hole 9.

Figure 3:
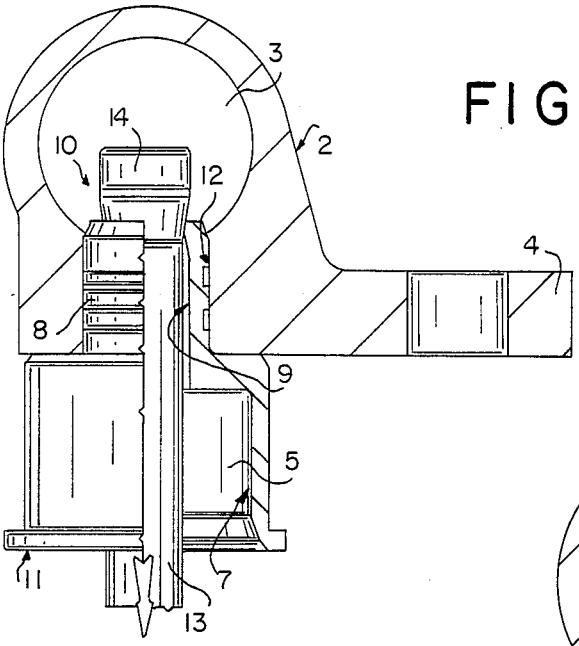
FIG. 3 shows a section of a number of parts on the manifold at one stage of the process for manufacturing the FIG. 1 manifold according to the present invention.
Figure 4:
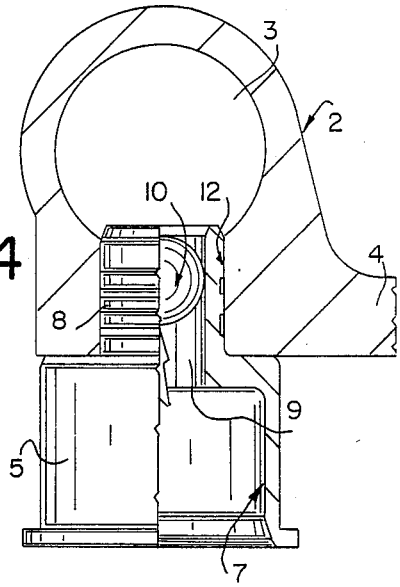
FIG. 4 shows the same parts on the manifold at an alternative manufacturing stage.

Before deforming rod 8, bar 13 is inserted inside hole 9 and housing 7 (FIG. 3) so as to rest head 14 on the top edge of rod 8. Rod 8 is then inserted inside seat 12, with the bottom edge 11 of fitting 5 resting on an appropriate locating surface (not shown). When pull is exerted on bar 13 in the direction of the arrow in FIG. 3, head 14 is pulled through hole 9, thus deforming rod 8 and force fitting it against seat 12. Moreover, head 14 also provides (FIG. 5) for turning the edge of rod 8 outwards, thus forming a collar 12*a* for further locking fitting 5 to semifinished part 2. Subsequent to permanent deformation of rod 8, tool 10 is pulled out downwards through hole 9 and housing 7 (FIG. 3). Deforming tool 10 may consist simply of a ball larger in diameter than hole 9 (FIG. 4), in which case, rod 8 may be permanently deformed by forcing said ball through hole 9 into hole 3 of semifinished part 2. This may be done using a thrusting tool (not shown) designed to exert thrust on the ball in the direction of the arrow in FIG. 4.

Figure 5:
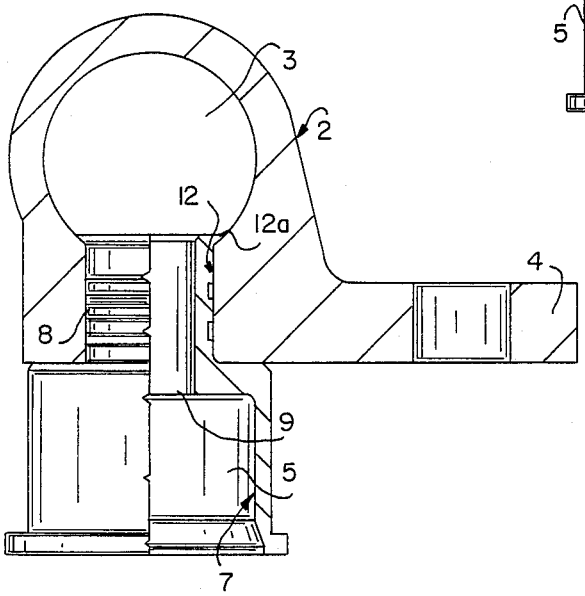
FIG. 5 shows a section of the connection between the fittings and semifinished part at the end of the process.

Radial deformation of rod 8 produces the connection shown in FIG. 5, which obviously presents excellent mechanical resistance and perfect sealing of the fuel through hole 3 in the manifold. Moreover, the operations involved in the process may be performed quickly and easily using low-cost tools.

To those skilled in the art it will be clear that changes may be made to the stages in the process as described and illustrated herein without, however, departing from the scope of the present invention.

We claim:

1. A process for the manufacture of a fuel manifold for an internal combustion engine fuel supply system which supplies fuel to a number of injectors, said process comprising the steps of:

forming an elongated semifinished metal part by extrusion, said semifinished metal part having a constant cross-sectional area, at least one axial hole, and a continuous tab projecting from one side of said semifinished metal part;

forming a plurality of seats in said semifinished metal part, each of said seats in communication with said axial hole in said semifinished metal part;

forming first fittings in said semifinished metal part, each of said first fittings defining a housing adapted to engage the top end of a respective one of the injectors, and having a short rod with a hole communicating with said housing, each said first fitting for enabling communication between said axial hole and the respective injector;

inserting said short rod of each said first fitting inside a respective one of said seats on said semifinished metal part;

integrally and permanently radially deforming each said short rod against a respective one of said seats for securing said fittings to said semifinished metal part, said deforming being performed by inserting through each said rod hole in each said short rod a deforming tool larger than said rod hole; and inserting second fittings inside two ends of said axial hole on said semifinished metal part, each said second fitting enabling communication between a respective end of said axial hole and piping on the fuel supply system.

2. The process of claim 1, wherein said deforming tool comprises a bar and a head connected to said bar, said head being larger than said rod hole of said first fitting; and said deforming step includes inserting said bar inside said rod hole such that said head comes into contact with said short rod; subsequently inserting said short rod inside said respective seat; and with said first fitting resting on an appropriate supporting surface, applying sufficient force by said bar to force said head through said rod hole and so permanently deform said short rod.

3. The process of claim 1 wherein said deforming tool comprises a sphere larger in diameter than said hole; said deforming step including exerting sufficient force on said sphere to force said sphere through said rod hole and so permanently deform said short rod.

4. The process of claim 2 wherein said head comprises a sphere larger in diameter than said hole; said deforming step including exerting sufficient force on said sphere to force said sphere through said rod hole and so permanently deform said short rod.

* * * * *